United States Patent [19]

Clokie

[11] 4,232,714

[45] Nov. 11, 1980

[54] TRAVELING YARN DISPENSERS

[75] Inventor: Andrew K. Clokie, Dewsbury, England

[73] Assignee: Greenbat, Limited, Leeds, England

[21] Appl. No.: 971,524

[22] Filed: Dec. 20, 1978

[30] Foreign Application Priority Data

Dec. 21, 1977 [GB] United Kingdom ..... 53361/77

[51] Int. Cl.[2] ..... D03D 51/34

[52] U.S. Cl. ..... 139/371; 139/13 A

[58] Field of Search ..... 139/13 A, 13 R, 370.1, 139/371

[56] References Cited

U.S. PATENT DOCUMENTS

| | | | |
|---|---|---|---|
| 2,433,479 | 12/1947 | Pelce | 139/371 |
| 2,535,369 | 12/1950 | Pelce | 139/371 |
| 2,587,982 | 3/1952 | Dunod | 139/371 |
| 3,298,401 | 1/1967 | Stutz | 139/371 |
| 3,322,162 | 5/1967 | Rydborn | 139/371 |
| 3,802,469 | 4/1974 | Loepfe | 139/371 |
| 4,031,924 | 6/1977 | Donig et al. | 139/371 |

*Primary Examiner*—Henry Jaudon

*Attorney, Agent, or Firm*—W. Thad Adams

[57] ABSTRACT

A travelling yarn dispenser for use in a textile machine, particularly a circular loom shuttle has an electric generator the rotor of which is adapted to be driven by yarn leaving the dispenser. In the preferred construction the driving member of the generator frictionally engages with the yarn carrier, which is mounted for rotation in the dispenser.

Several arrangements for using the current generated by the generator to give weft failure signals and pick-up means adapted to co-operate with these arrangements are described.

6 Claims, 10 Drawing Figures

TRAVELING YARN DISPENSERS

In machines wherein a yarn is traversed from a stationary dispenser, such as a cheese, bobbin or creel in a spinning, twisting, winding or like machine, or a beam in a warping frame or loom, there are various ways of detecting failure of a yarn supply due to either end breakage or the supply becoming exhausted. For instance, in spinning and twisting machines, it is known to employ a feeler pressing against each yarn and adapted to move if the yarn fails, to a position where it activates a brake applied to the winding-on mechanism for that particular yarn. In the case of the warp threads in a loom, it is usual to provide drop wires supported on warp threads, and each arranged to fall into a position where it activates a loom stop mechanism if its supporting warp thread breaks.

It is more difficult to detect yarn failure if the yarn is dispensed from a travelling dispenser, such as a loom shuttle, weft carrier or rapier. Exhaustion of the weft supply in a shuttle can be detected by a photo-electric device adapted to be operated by light reflected from a reflector uncovered when the weft is almost exhausted, but such a system only operates when the shuttle is housed in a shuttle box, and hence this method cannot be used on a circular loom wherein the shuttle is not arrested during normal loom operation. Moreover, this method cannot be used to detect weft failure due to yarn breakage. Weft failure in a flat loom can also be detected by a mechanical weft fork mechanism, but as this relies on the reciprocating beat-up motion of the loom reed, it cannot be used on a circular loom.

The circular loom presents a special problem of weft failure detection therefore, and it is the principal object of the present invention to provide a means of solving this problem. It is to be understood however, that the invention can also be used in connection with travelling yarn dispensers other than circular loom shuttles.

Another problem encountered in circular looms is that of arresting the shuttles when failure of the weft supply is detected. This is because the inertia of the shuttle driving mechanism (including the shuttles themselves) causes the shuttles to continue their rotation for some time after the electrical supply to the loom driving motor has been cut-off and therefore, there will be an absence of weft in the woven fabric for a length corresponding to the sum of (i) the time between failure of the weft supply and cutting of the electrical supply under the control of the weft detection system, and (ii) the running down time of the shuttles due to inertia. Now the weft detection system cannot affect the inertia of the shuttles, so that it is all the more important that it shall signal weft exhaustion or weft breakage (all referred to hereinafter as weft failure) as early as possible, so that there is a minimum delay between failure of the weft supply and cessation of the drive to the shuttles.

According to this invention a travelling yarn dispenser for use in a textile machine carries an electric generator, the rotor of which is adapted to be driven by yarn leaving the dispenser.

According to a preferred feature of the invention, the generator has a driving member adapted to rotate with the rotor, the driving member being further adapted to frictionally engage with a yarn carrier when the latter is mounted in the dispenser, so that rotation of the yarn carrier produces rotation of the driving member. The travelling dispenser may have a pair of axially aligned rotary mountings on which the ends of a tubular yarn carrier can be received as a means of mounting the yarn carrier for rotation in the dispenser. In that case, one of the rotary mountings may comprise the driving member of the generator.

In one arrangement in accordance with the invention, there is a radio-frequency transmitter on the yarn dispenser, adapted to be activated by the electrical current produced by the generator there being decelleration detecting means responsive to a decelleration of the rotation of the rotor of the generator and adapted to gate the transmitter into the activated condition only when decelleration of the rotor is detected. The radio-frequency signal from the transmitter, which constitutes a weft failure signal only occurs when the rotor begins to decellerate due to the fact that yarn is not leaving the yarn dispenser. There may be a rectifier arranged to convert the alternating current produced by the generator into a direct current which is supplied to the transmitter.

The decelleration detecting means preferably comprises first and second capacitors arranged in parallel across a supply voltage direct current from the rectifier, with a stand-off voltage system arranged between them, so that the second capacitor will be at a lower potential than the first capacitor, due to the stand-off effect, so long as the supply voltage is constant or rising, and a transistor also connected between the two capacitors, in such a manner that it is in a non-conducting state so long as the voltage across the second capacitor remains lower than that across the first capacitor, but will conduct and discharge the second capacitor through a sensing part of the apparatus if the voltage across the second capacitor exceeds that across the first capacitor. Since the voltage at the second capacitor can only fall below that at the first capacitor if the supply voltage begins to fall, the appearance of a current through the sensing part of the apparatus will give a signal that the supply voltage has commenced to fall.

Preferably the stand-off voltage system comprises a diode arranged to permit current flow from the first to the second capacitors. It is further preferred that the base of the transistor is connected to the first capacitor side of the diode and the emitter to the second capacitor side of the diode, the collector being connected to the sensing part of the apparatus. With this arrangement, so long as the second capacitor is at a voltage lower than the first capacitor, the base/emitter junction of the transistor will be reverse biased and consequently the transistor will be in a quiescent (non-conducting) state. Hence no current will appear at the sensing part of the apparatus. However, if the voltage at the second capictor exceeds that at the first capacitor, then since current cannot flow through the diode from the second capacitor to the first capacitor, the base/emitter junction of the transistor will become positively biased and the transistor will start to conduct and will discharge the second capacitor through the sensing part of the apparatus.

The sensing part of the apparatus may comprise a resistor, an inductance coil or any other electrically responsive component or combination of components.

In this preferred arrangement in which the yarn failure signal takes the form of a radio-frequency transmission, the power for that transmission is derived from the generator, and this power is always available whilst the rotor of the generator is being rotated by the yarn being dispensed and for a short period after the yarn has failed due to the inertia of the rotor and any parts connected to the rotor. Further the activation of the transmitter is under the control of the decelleration detecting means which senses the reduction in the generated voltage due to yarn failure. Thus the generator serves two purposes, to power the transmitter and to provide the input voltage for the decelleration detecting means.

In an alternative arrangement, there is a coil on the yarn dispenser, adapted to produce a magnetic field, and adapted to be excited by current produced by the generator. There may also be a permanent magnet located in advance of or behind the coil, having regard to the direction of movement of the dispenser in the machine. In yet another arrangement, there is a light source on the yarn dispenser, adapted to be illuminated by current produced by the generation; the light source may be a light emitting diode (LED).

The invention also includes a textile machine in which there is a travelling yarn dispenser in accordance with the invention and a detector on a stationary part of the machine adapted to sense a yarn failure signal powered by the dispenser generator, the detector being arranged to control a function of the machine in accordance with the detected presence or absence of the said yarn failure signal. Preferably, the detector is arranged to cause the machine to stop if the said yarn failure signal occurs. In the case of a loom for example, detection of the signal may be used to disconnect the electrical supply to the loom driving motor or to discontinue the loom drive and/or to apply a brake to the moving parts.

According to a preferred arrangement, the detector includes an element adapted to pick-up a yarn-failure signal from the travelling yarn dispenser at substantially all positions along the path of travel of the dispenser in the machine. In the case of a radio-frequency yarn-failure signal, the element comprises an aerial, and if the yarn dispenser travels a circular path (as in the case of a circular loom) the aerial may be formed into a circle with its ends almost abutting each other. In an alternative arrangement, the detector is disposed in a discrete position relative to the path of movement of the dispenser, and there is an electrical gating system whereby the detector will only cause the machine to be stopped if the absence of a dispenser signal is sensed at the time in the machine cycle when the dispenser is passing the detector. The gating system may include a signal producing device carried by the yarn dispenser, whereby the latter is self-gating. In one arrangement for example, the signal producing device comprises a permanent magnet.

According to another preferred feature of the invention, the gating system includes a rotary signal producing device geared to the machine driving mechanism so that it rotates at an angular velocity directly related to that of the yarn dispenser, and a proximity switch positioned adjacent to the rotary member for activation thereby, there being a cut-away in the rotary member corresponding to the location of the yarn dispenser, whereby a signal only appears at the proximity switch when the yarn dispenser should be passing the detector.

In both these alternative arrangements, the signal from the dispenser powered by the generator is present so long as the yarn is being dispensed, and the decelleration detection means is not used. Instead, the signal disappears as the rotor of the generator ceases to rotate and the absence of the dispenser signal is used to indicate yarn failure. It will be appreciated that the generator could be used to power other signal producing devices.

If the machine is equipped with a yarn dispenser having a light source, then the detector may be photoelectric device adapted to detect the light emitted by the light source on the yarn dispenser. If the light source is a light emitting diode, then the detector is preferably pre-set to respond only to light at the high frequency of the LED, thus avoiding false response to other light rays, such as rays reflected off the yarn dispenser, the yarn itself, or other parts of the machine.

If the machine is equipped with a yarn dispenser having a coil, then the detector may comprise a Hall effect sensor.

The invention is particularly applicable to circular looms, and the yarn dispenser may constitute a loom shuttle.

Several arrangements, in each of which the invention is applied to a circular loom, will now be described by way of examples only, with reference to the accompanying drawings, in which.

Figure 1:
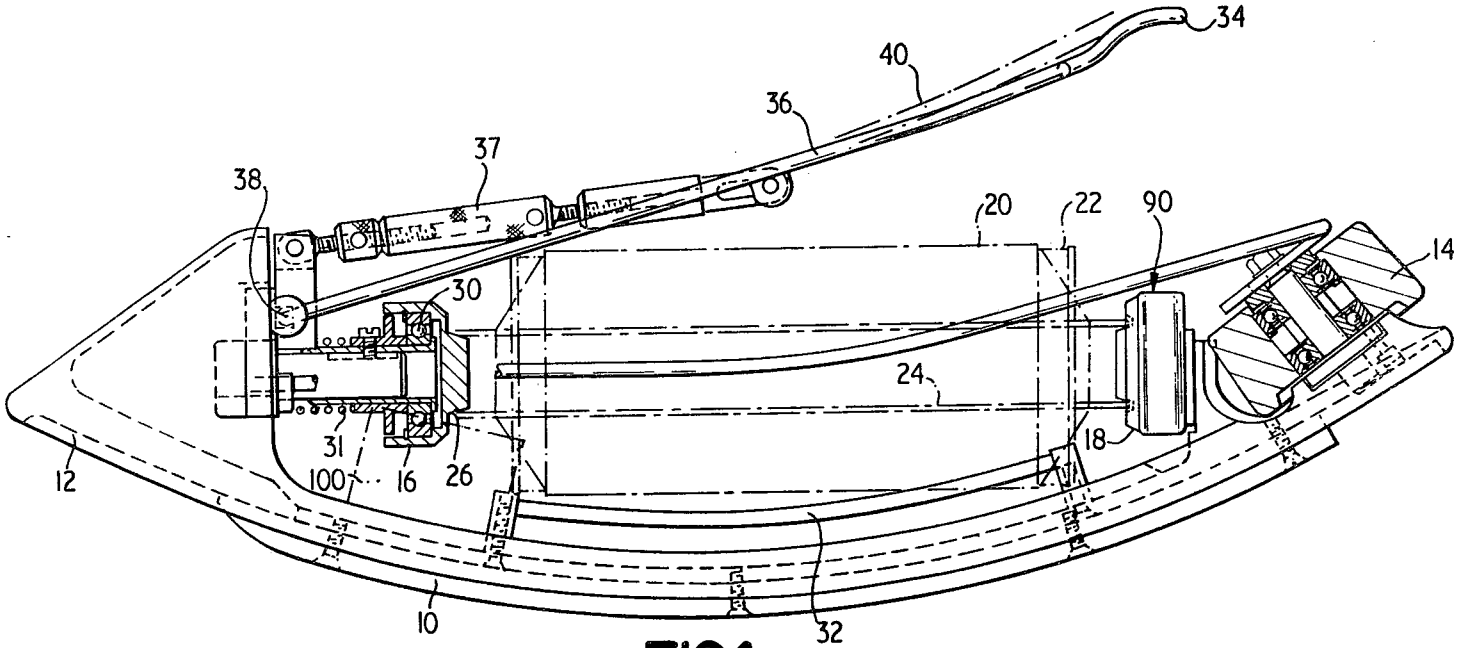
FIG. 1 is a plan view of a circular loom shuttle.
Figure 2:
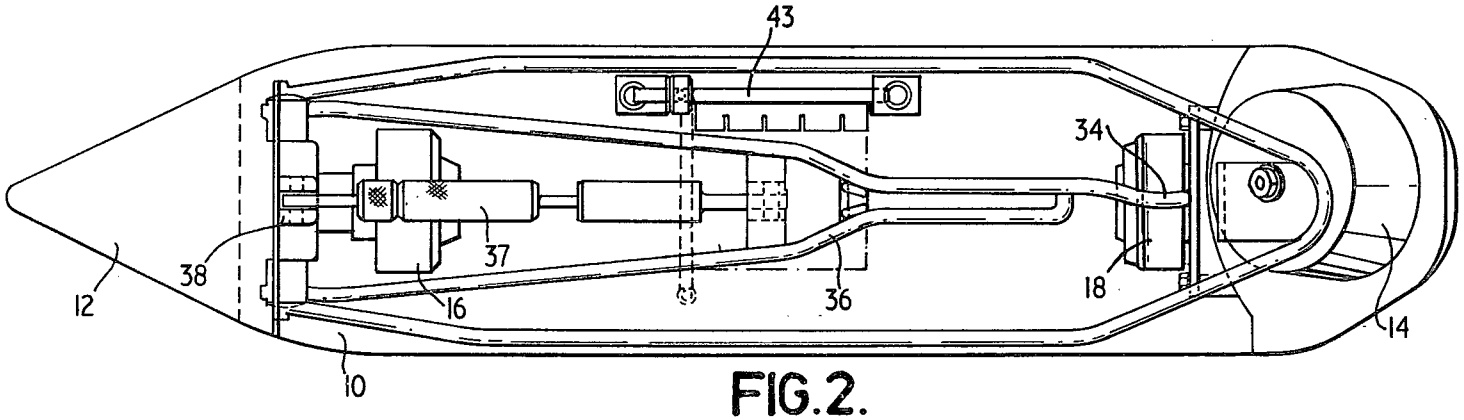
FIG. 2 is a side elevation of the shuttle shown in FIG. 1.
Figure 3:
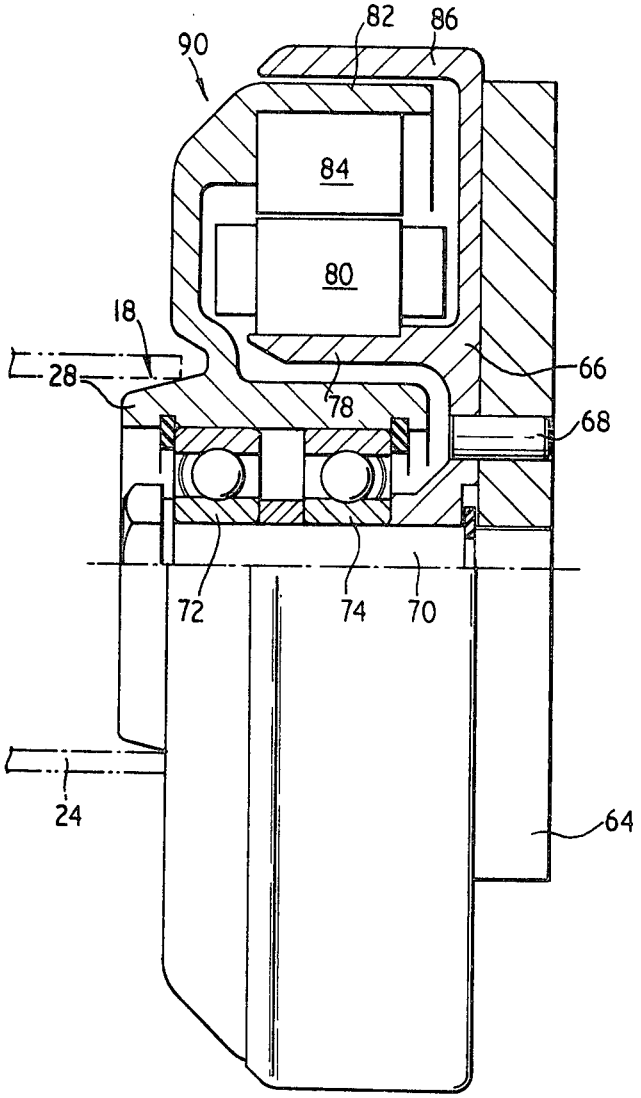
Figure 4:
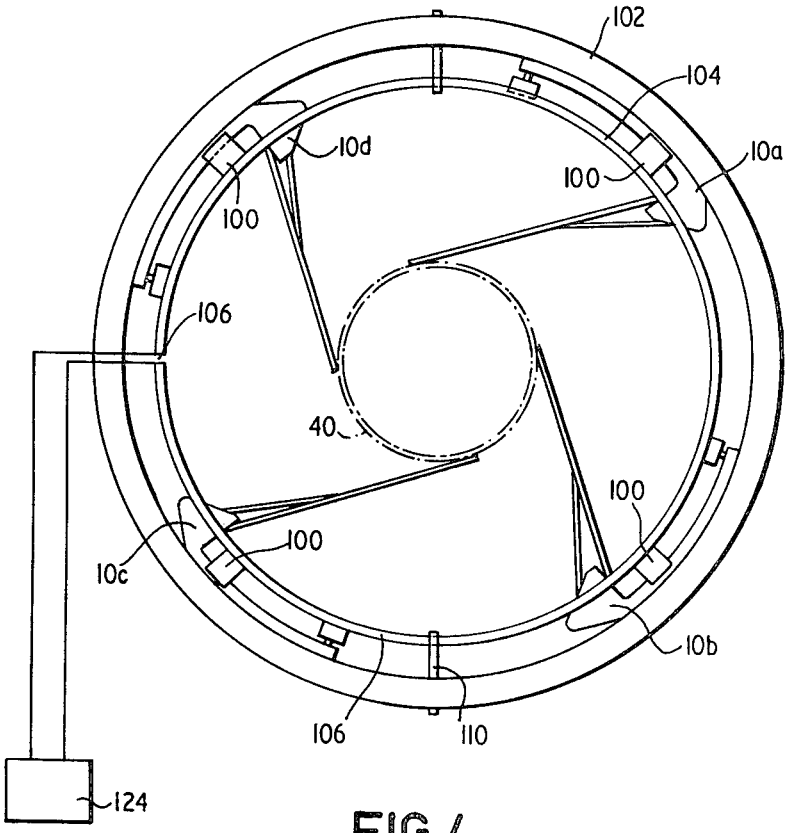
Figure 5:
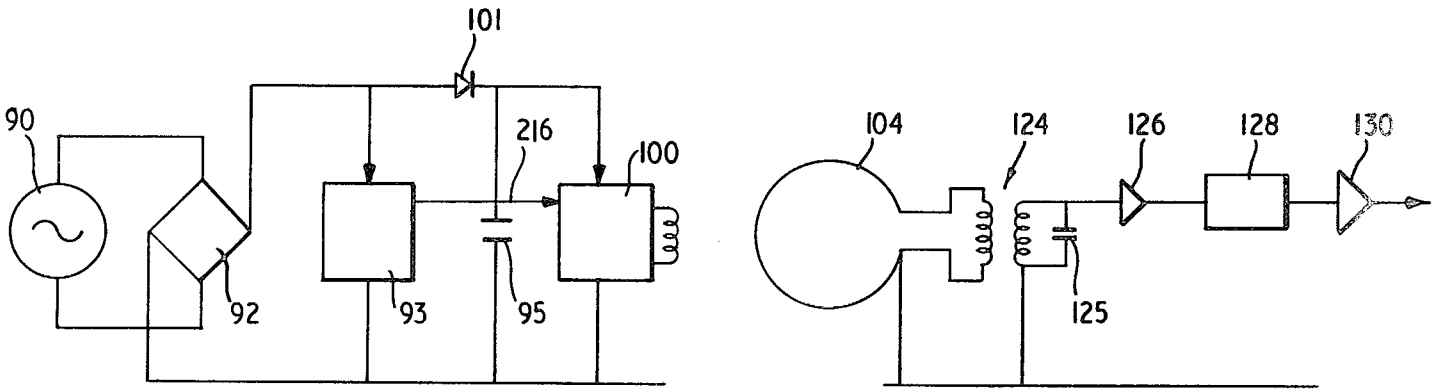
Figure 6:
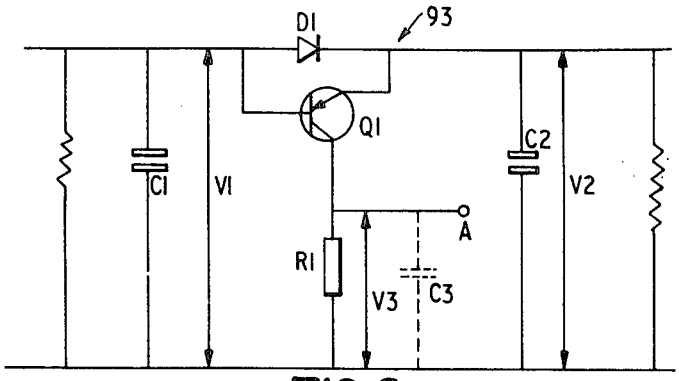
Figure 7:
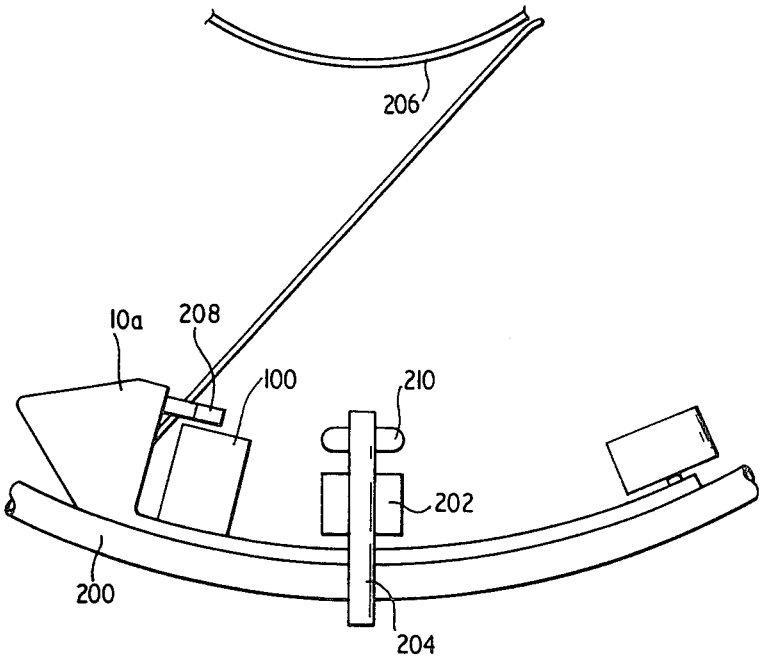
Figure 8:
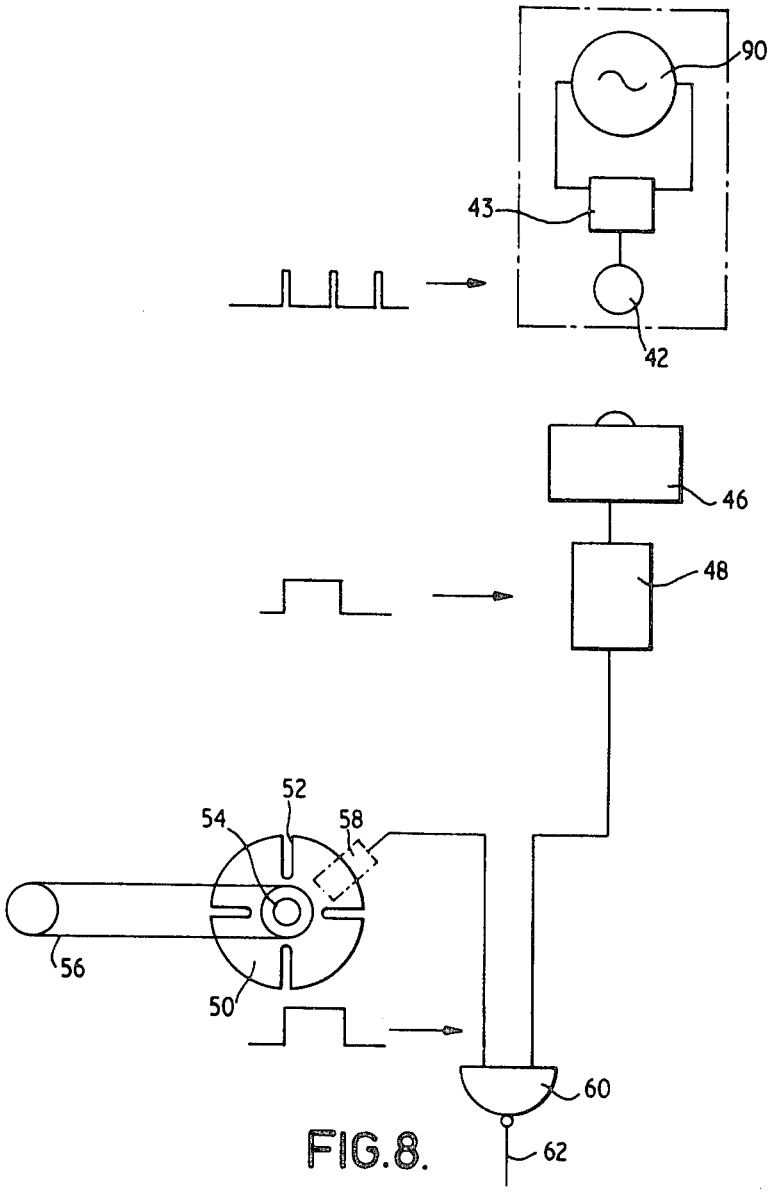
Figure 9:
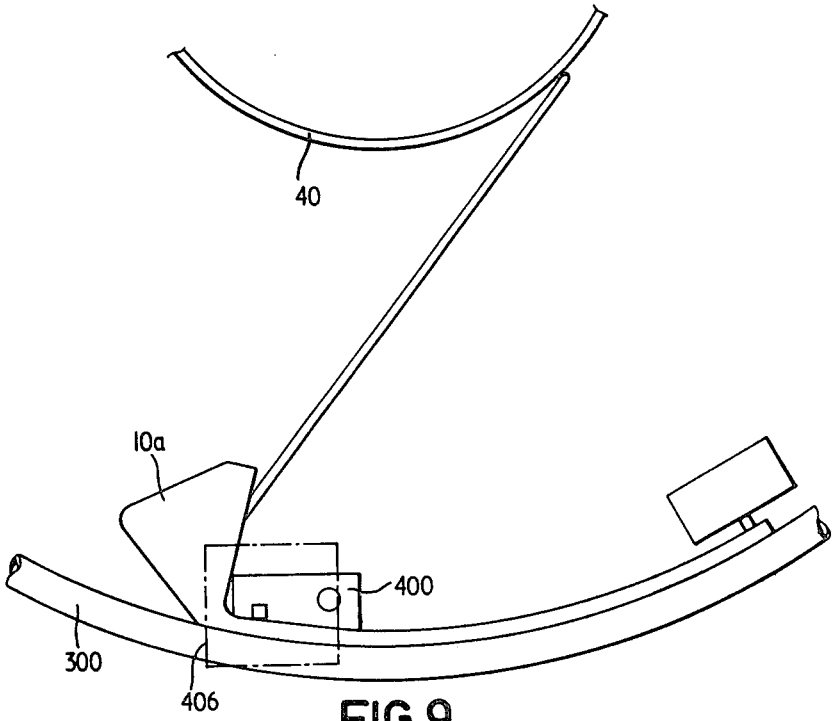
Figure 10:
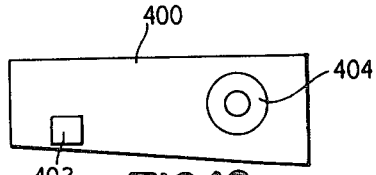

FIG. 3 is a section through a generator, used in the shuttle shown in FIGS. 1 and 2, FIG. 4 is a diagrammatic plan view of a circular loom employing shuttles as illustrated in FIGS. 1 to 3, and showing a weft detection system, FIG. 5 is a block diagram of the weft detection system shown in FIG. 4, FIG. 6 is an electrical diagram of a decelleration detection means, FIG. 7 is a part plan view similar to FIG. 4, but illustrating an alternative weft detection system, FIG. 8 is a block diagram illustrating an alternative weft detection arrangement, FIG. 9 is a view similar to FIG. 7, but illustrating another weft detection arrangement, and FIG. 10 is a diagrammatic plan view of an indicator section of a shuttle.

The loom itself is generally of conventional construction, that is to say it has a stationary framework supporting the shedding mechanism, and a circular track, on which the shuttles rotate about a vertical axis. In FIGS. 1 and 2, there is shown a shuttle which is also of generally known construction intended to be used in the loom. It will be appreciated by those skilled in the art, that a plurality of such shuttles is arranged in the loom, in this particular instance four, and that each shuttle travels in its own travelling shed of warp threads, as the main driving shaft (not shown) of the loom is rotated. The four shuttles in this particular arrangement are arranged at 90° intervals around the vertical axis of the loom.

Each shuttle has a body 10, which as seen in FIG. 1, is generally arcuate, following the curvature of the track (not shown) on which the shuttle has to run in the loom. The nose 12 of the shuttle is pointed, to ease the passage of the shuttle through the warp threads as they open in front of the shuttle, and at the rear end of the shuttle there is a freely rotatable roller 14, which engages with a driving member (not shown) whereby the shuttle is propelled around its circular path. Incorporated in the shuttle construction are front and rear yarn package mounting members 16 and 18, adapted to receive a yarn package between them. As indicated by the chain-dotted lines in FIG. 1, the weft package itself may be a parallel package 22, in which case there are disc flanges at each end of the weft, or it may be a taper end package 20, in which case no end flanges are required. In any case however, the weft package will have a central tube 24, the ends of which are received on frusto-conical portions 26 and 28 respectively of the package mounting members 16 and 18. The latter are free to rotate on journal bearings, one of which is shown at 30 in FIG. 1, and whilst the moutning 18 is axially fixed, the mounting 16 is axially movable and is loaded by a spring 31 towards the mounting 18, so that the tube 24 of a package 20 or 22 can only be fitted into the shuttle, by forcing the mounting 16 forwardly against the action of the spring 31, and when the mounting 16 is allowed to return under its spring loading towards the rear, it presses its frusto-conical portion 26 into the front end of the tube 24 and forces the rear end of the tube 24 into frictional engagement with the frusto-conical portion 28 of the mounting member 18. In this way, the weft package is held by friction between the two mounting members, and the weft package is then free to rotate about its own longitudinal axis by virtue of the journal bearing mounting of the mounting members 16 and 18.

An arcuate rail 32 is provided within the shuttle body, and the weft drawn off the package 20 or 22 is first carried around the outside of the rail 32, and then passes inwardly toward a weft guiding arrangement 34 at the free end of a boom 36, which is pivoted on the shuttle body 10 at 38. The boom 36 is held by an adjustable length strut 37 in an inclined position as illustrated in FIG. 1, where its free end runs of a vertical tube 40 (forming part of the loom) over which the woven fabric is formed during the weaving process. It is possible to employ tubes 40 of differing diameters according to the diameter of fabric "tube" which is to be produced, but changes in the tube diameter can be accommodated by varying the length of the strut 37 and hence the angle of inclination of the boom 36.

As the shuttle travels around the loom, weft is payed out from the weft package 20 or 22 in the shuttle, this weft being drawn into the fell of the cloth, which is being formed to the rear of the shuttle. The weft package 20 or 22 is caused to rotate about its longitudinal axis by the tension in the weft which is being drawn off that package, and because the weft package itself rotates, no twist is inserted into or taken out of the weft yarn as a result of the release of the weft from the shuttle. This method of withdrawing the weft from the shuttle is of advantage where flat tape weft is being used as in the case of sack production using flat polypropylene tape for both the warp and weft. However, the fact that the weft package and its mountings 16 and 18 rotate is made use of in the present invention.

The mounting member 18 is formed as the rotor of a small electric generator indicated generally at 90, and illustrated in detail in FIG. 3. A mounting plate 64 is secured to the shuttle body 10, and a stator 66 is fastened to the plate 64 by a pin 68. An axle 70 is also fastened to the plate 64 and provides a mounting for a pair of journal bearings 72 and 74 on which the mounting member 18 is rotatably mounted. An annular boss 78 formed on the stator carries stator windings 80 of the generator. An annular flange 82 on the mounting member 18 surrounds the stator windings 80, and a plurality of permanent magnets 84 is secured to the inside of the this flange, to provide the rotor of the generator. A very compact electrical generator is thus formed, in which the mounting member 18, with its frusto-conical portion 28 for the reception of the weft package tube 24, provides the rotor.

The stator 66 also has an annular shroud 86 closely surrounding the flange 82 of the rotor. This shroud prevents yarn being trapped between the rotor and stator, because the entrance to the gap between the rotor and stator is in an end face rather than in a peripheral face. It will be observed that the shroud 86 and the end of the mounting member 18 are bevelled to a common part-conical surface which also deters the entrance of yarn between the rotor and stator.

So long as the weft package is rotating due to yarn being drawn off from it, an electrical current will be generated by rotation of the mounting member 18. However, if the weft supply on the package 20 or 22 becomes exhausted, or the weft yarn being drawn off the package breaks, then the tube 24 will cease its rotation, and the generator which includes the rotor formed by the mounting 18 will cease to generate a current. The apparatus which is fitted on the loom, makes use of the difference between the presence or absence of an electrical current generated by the rotation of the mounting 18, to indicate whether or not weft is being drawn off the weft package. It will be appreciated however, that the inertia of the weft package mounting arrangement will produce some over-run of the mounting 18 (and therefore generation of a current) after the yarn has failed. The present arrangement however provides apparatus for detecting almost immediately when there is a yarn failure. It will be appreciated, that weft is drawn into the woven fabric at a constant linear velocity, but that as the weft is withdrawn from the yarn package, the radius at which it is leaving the package is constantly reducing. Hence, the angular velocity of the tube 24, and therefore that of the rotor of the generator is constantly increasing throughout the period during which weft is being supplied from the yarn package. Thus, the value dv/dt (where v is the angular velocity of the tube 24) is positive.

A rectifier 92 (see FIG. 5) is also provided on the shuttle, and as indicated diagrammatically in that figure, the electrical potential produced by the generator 90, which will have a sinusoidal wave form, is applied to the rectifier 92, which converts the input voltage to a d.c. voltage output. This output voltage will be constantly increasing due to the increasing angular velocity (v) of the rotor of the generator. In other words, the output voltage (V) of the rectifier 92 can be regarded as directly proportional to the angular velocity (v) of the tube 24. The generator 90 therefore provides a means of producing a voltage which is substantially directly proportional to the angular velocity of the moving part, that is the tube 24 of the yarn package.

A small flat radio frequency transmitter 100, shown in chain-dotted lines in FIG. 1, is fixed inside the nose end of the shuttle, and the output from the rectifier 92 is applied to this transmitter, via a diode 101. The rectifier 92 and diode 101 are in fact contained in the same housing as the transmitter 100. The transmitter 100 is adapted to produce an output signal in the radio frequency band, and in this specific example, it has an output of 130 kHz. The electrical system of the shuttle is arranged so that the strength of the generated radio frequency emission is only effective within a range of a few centimeters.

Referring to FIG. 5, it will be seen that the output from the rectifier 92, is also applied to a deceleration detector apparatus 93, which, is illustrated in detail in FIG. 6. The deceleration detection apparatus 93 is also housed within the same casing as the transmitter 100. First and second capacitors C1,C2 are arranged in parallel across and d.c. supply from the rectifier 92, and a diode D1 is arranged between the two capacitors. A transistor Q1 is shunted across the diode D1 and a resistor R1 is connected to the emitter of the transistor Q1.

The supply voltage V1 is applied across the first capacitor C1, and this voltage V1 changes rapidly in sympathy with the applied voltage—that is the voltage proportional to the angular velocity of the weft package. At the same time, the capacitor C2 is charged at a similar rate, via the diode D1, but it only reaches a voltage V2, which is inherently lower than the voltage V1, due to the intrinsic stand-off voltage across D1. Because of this difference in the voltages V1 and V2, the transistor Q1 will be forced into a non-conducting state, due to the base/emitter junction being reverse biased. This situation will continue so long as the voltage V1 is rising or is steady, and as has previously been described, this voltage should be continuously rising throughout the period that weft is being drawn off the yarn package.

Supposing that there is a failure in the weft, so that the tube 24 and the rotor of the generator only continue to rotate by virtue of their inertia, then immediately, the voltage V1 will begin to drop, and as soon as the voltage V1 becomes less than the voltage V2, the base/emitter of the transistor Q1 will become positively biased, and the transistor will start to conduct, discharging the second capacitor C2, through the resistor R1, and causing a voltage to appear at an output A.

The output at A is taken via a lead 216 (see FIG. 5) to the transmitter 100, and is arranged to gate the transmitter 100, so that the latter will only emit a radio frequency, signal, when a signal appears at the output A of the deceleration detector circuit 93. Now it will be appreciated, that the reaction of the electrical detection system illustrated in FIG. 6 is very rapid, so that the emission from the transmitter 100, will occur, almost immediately there is a failure of the weft supply. Consequently, the response time of the entire weft failure detection system is very much reduced, and of course this is of advantage, since it reduces the length of fabric in which there is an absence of weft yarn.

Since the fall in the voltage V1 may be quite small, the voltage V2 will rapidly fall below the voltage V1, and once it has reached a level below that of V1, the transistor Q1 is immediately turned off, and the signal ceases to appear at the output A. However, if the voltage V1 continues to decrease (as it will do in the case of a decelerating generator) the condition will be again arrived at where the voltage V1 is less than the voltage V2, at which point the transistor Q1 will again begin to discharge the capacitor C2. Consequently, the output at A will appear as a series of pulses. Since this may be undesirable, it is possible to introduce a third capacitor, shown at C3 in FIG. 6, which provides integration of the pulses across the resistor R1, giving a continuous output at A.

The sensitivity of the circuit shown in FIG. 6, can be altered by inserting additional diodes in series with the diode D1, thereby altering the stand-off ratio between the voltages V1 and V2. In other words, due to the additional diodes, the capacitor C2 will charge to an even lower potential than the capacitor C1, and therefore the voltage V1 will have to fall farther, before the transistor Q1 is switched on to discharge the transistor C2.

Since the circuit shown in FIG. 6 relies upon the discharge of the second capacitor C2 to obtain an impulse from the transistor Q1, the circuit is not reversible to give pulses on acceleration of the generator. This is because, in acceleration, the voltage V2 has to remain lower than the voltage V1, and therefore the circuit must become a capacitor charge circuit, which is an entirely different configuration.

Turning now to FIGS. 4 and 5, it will be appreciated that only a few elements of the loom are illustrated, sufficient for an understanding of the operation of the invention. The tube 40 and the reed retaining ring 102 which are concentric and stationary are shown in FIG. 4. The reed retaining ring is located a short distance above the top end of the tube 40. The warp yarns pass over the reed retaining ring from the outside, and then travel radially inwards to the top of the tube 40. Four shuttles 10*a*, 10*b*, 10*c* and 10*d* are provided in the loom, and these are arranged to travel in a circular path about the vertical axis of the loom, the shuttles being disposed in the annular region between the ring 102 and the tube 40. The warp threads in the said annular region are divided into four travelling sheds, one for each shuttle, by the loom shedding motion (not shown). This arrangement of the shuttles in the loom is conventional, and has only been described in order to set out the environment of the invention.

A radio pick-up aerial 104 is provided, this aerial being formed into almost a complete circle, with only a small gap 106 between its ends. The radius of the aerial is smaller than the inside radius of the reed retaining ring 102, but the aerial is within the depth of the ring 102, and the annular gap between the inside of the ring 102 and the aerial 104 is approximately 25 millimeters wide in the particular loom which is being described. Moreover, the arrangement is such that each of the transmitters 100 lies underneath this annular space when the shuttles are in their operative locations in the loom. As is indicated in FIG. 4, each of the transmitters bridges the annular gap as seen from above, but in fact the shuttles are located below the ring 102 and hence below the aerial 104, but the aerial is well within the range of the transmitters 100.

The ends of the aerial 104 are connected as illustrated in FIG. 5, to a tuned circuit 124, which essentially comprises a transformer. A capacitor 125 is arranged in parallel with the secondary of the tuned circuit 124, for the purpose of smoothing out the input signals from the tuned circuit.

The output from the tuned circuit is applied to an integrated circuit detector 126, and to a pulse stretcher circuit 128 of known construction. The output signal from the pulse stretcher is taken to a control circuit 130 which is arranged, so that when it is activated, it disconnects the electrical supply to the loom driving motor, and hence brings the loom to rest.

The overall operation of the weft failure detection system will now be described.

So long as each of the four shuttles 10*a*, 10*b*, 10*c* and 10*d* contains an adequate weft supply, and that weft is being drawn off, the generator 90 of each shuttle will be generating an output current. However, the deceleration detector circuit 95 will sense that the angular velocity of the tube 24 on which the weft is wound, is either constant or increasing in value, and hence will not give an output signal, thereby allowing the transmitter 100 to remain in a quiescent state. Hence, no signals are detected by the aerial 104, and the loom will continue to run.

As soon as the weft from any one shuttle fails either because of exhaustion of the weft supply, or because the weft thread has broken, there will be an immediate deceleration of the tube 24, and this will produce a corresponding decrease in the output voltage from the generator 90. This reduction in voltage will be immediately detected by the deceleration detector circuit 93, which will activate the transmitter 100. So long as there is an output signal from the circuit 93, a radio frequency signal will appear at the transmitter 100 of that shuttle in which there is a failure of weft supply. Consequently, the aerial 104 will pick up the transmitted signal, and it is a significant feature of the invention, that this pick up will occur, no matter what the position of the shuttle at the time when the weft failure occurs.

On detection of a signal by the aerial 104, an output signal appears at the output circuit 130, the pulse stretcher 128 being effective to ensure that the signal at the output circuit 130 is sufficiently long to activate that circuit, even if the signal received by the aerial 104 is extremely short. This provides that the detection system is extremely sensitive, which consequently ensures a rapid response of the overall weft failure detection system.

The arrangement described above with reference to FIGS. 1 to 6 presents a very effective method of bringing the circular loom to rest on failure of the weft supply from any one of its shuttles. It meets the problem of transferring a signal from the continuously moving shuttles to the stationary parts of the loom by the use of a transmitter, and it uses the actual withdrawal of the weft yarn as a method of generating the radio frequency signal. Moreover, the arrangement of the aerial 104 ensures virtually constant monitoring of the weft supply from each of the four shuttles avoids the necessity for more complex arrangements where the monitoring only occurs at certain times in a cycle of the loom.

In the arrangement described above, there is a single aerial forming almost a complete circle around the path of the shuttles. In an alternative arrangement, there is a plurality of arcuate aerials arranged end-to-end, so that together they form a complete circle. Each arcuate aerial can pick up a signal from whichever shuttle is passing it, and in this way there is continuous monitoring of all the weft supply from all the shuttles. With this arrangement, it is possible to dispense with the deceleration detection means and to produce a continuous output from each transmitter 100 so long as weft is being payed out. The signals picked up by the four aerials are fed to a logic circuit arranged to give an output which will initiate stoppage of the loom if the signal from any one shuttle ceases.

In FIG. 7, there is illustrated a loom similar to that shown in FIG. 4, and having four shuttles 10*a*, 10*b*, 10*c* and 10*d* identical with those shown in FIG. 4. However, in this arrangement, the decelleration detecting means 93 is not employed, and consequently there is a transmission from the transmitter 100 of each shuttle, powered by the generator 90, so long as the weft supply from that shuttle is being maintained.

The loom also has the usual reed retaining ring 200, but in this arrangement, instead of the aerial, there is a single tuned circuit receiver 202 carried by a rod 204 extending radially inwards from the ring 200 over the annular space between the ring 200 and the tube 206 over which the fabric is formed. Hence the receiver 202 is positioned over the path of movement of the transmitters 100 on the shuttles. It will be apparent therefore, that the single receiver 202 (which is similar in arrangement to the receiver shown in FIG. 5) will give an output signal in the form of a logical (1) each time one of the four shuttles is passing under it (i.e. it gives four signals per cycle of the loom). The receiver is arranged so that it only picks up the signal from each transmitter when that transmitter is within a few millimeters on each side of the receiver.

A permanent magnet 208 is positioned in each of the shuttles, and a reed switch 210 also carried by the rod 204 is adapted to be actuated by these permanent magnets. The arrangement of the reed switch is such that it is only actuated after the receiver 202 has begun to receive a signal from the transmitter of the shuttle and is de-activated before the receiver ceases to receive a signal from the transmitter. In other words, the reed switch output signal only appears during the period when the receiver 202 should be picking up a signal from the transmitter if weft is being delivered from that shuttle.

The reed switch is arranged in a control circuit so that when it is activated, it will cause the loom to be stopped to bring the shuttles to rest. However, the receiver 202 is arranged to "gate" the reed switch circuit "open" when it is activated, so that the operation of the reed switch has no effect if the transmitter is operated. If the weft supply has failed, and consequently there is no signal emitted from the transmitter, then activation of the reed switch will cause the loom to be arrested.

This system employing permanent magnets in the shuttles and a reed switch on a stationary part of the loom provides in effect self-gating by the shuttles of the weft detecting signals.

It is possible to use the electric current generator 90 in each shuttle to operate alternative weft detection systems, which do not employ radio frequency transmissions. In one such arrangement, instead of the transmitter 100, each shuttle is provided with a light emitting diode (LED) type lamp 42 (see FIG. 8) and the generator 90 is connected to a lamp driving circuit, to provide the operating current for the lamp. As indicated diagrammatically in FIG. 8, the lamp driving circuit includes an integrated circuit 43 which modulates the LED lamp, to provide very short duration high power pulses at approximately 5 kHz. Hence, as long as the shuttle is functioning normally, the lamp 42 will be illuminated with the 5 kHz frequency.

At one position on the loom reed retaining ring, near to the path of travel of the lamp 42, there is a photoelectric detector 46, which is arranged to receive light rays emitted from the lamp 42 as the shuttle passes over the photo-detector. The photo-detector 46 is connected to a frequency sensitive switch 48 in such a manner, that an output signal will only appear from the switch, if the photo-detector 46 detects a light emission at the correct 5 kHz frequency from the lamp 42. In this way, the photo-detector system is made responsive only to the preselected frequency and this feature prevents false signals being given to reflections from apparatus other than the lamp 42.

A gating system is provided, whereby the detector system is only operative when a shuttle is passing over the photo-detector 46. For this purpose, there is a proximity switch 58 mounted on a stationary part of the loom, adjacent to an operating disc 50. The latter has a series of cut-outs 52 in its periphery, corresponding to the number of shuttles in the loom, and is rotatable about an axis 54. A driving mechanism indicated diagrammatically at 56 in FIG. 8, connects the operating disc to the driving mechanism for the loom main shaft, and the arrangement is such that the operating disc rotates at the same angular velocity as the loom driving shaft. Furthermore, this position of the operating disc adjacent to the proximity switch 58 is such, that so long as a solid part of the disc is passing the switch 58, no output signal appears from that switch, but an output signal is given, when one of the gaps 52 is opposite the switch 58.

The control circuit also includes a coincidence gate 60, and both the output signals from the frequency sensitive switch 48 and the proximity switch 58 are taken into the coincidence gate, which acts as a logical AND gate. Consequently, an output signal only appears at the output lead 62 from the AND gate when signals are received from both the switches 48 and 58, indicating that at an appropriate time for a shuttle to be passing the photo-detector, the latter has sensed that the lamp 42 appertaining to that shuttle is being illuminated at the correct frequency. The output signal is taken to a control circuit (not shown) for the operation of the loom, and so long as a signal appears at 62, the loom is kept in motion, but if the signal at 62 is cancelled, the motor driving the loom is immediately disconnected from its electrical supply thus bringing the loom to rest.

The control circuit also includes a time delay initial starting arrangement, whereby the circuitry shown in FIG. 8 is inhibited during the run-up period during which the loom is working up to its operating speed. As soon as this initial starting arrangement cancels itself, the circuit illustrated in FIG. 8 becomes operative, and thereafter there is a failure of the weft supply in any one of the shuttles, the loom will immediately be brought to rest.

It will be appreciated, that as with the radio frequency system described with reference to FIGS. 1 to 6, the photo-electric system shown in FIG. 8 has no electrical connection between the shuttle and the stationary parts of the loom, since the generator 90 for the current required to operate the lamp 42 forms part of the shuttle construction. Moreover, the arrangement is more reliable than known photo-electric detector systems, which rely on light reflected from a flag carried by the boom 36, because there is always a danger that the light will be reflected from some other part of the loom or shuttle.

The lamp 42 is so positioned, that it is wiped by the warp threads as the shuttle travels around the loom, and this keeps the lamp clean, ensuring its efficient operation.

The gating system illustrated in FIG. 8 could also be used with the radio frequency system described above with reference to FIG. 7, in which case the permanent magnets and the reed switch would not be required. In that case, the output signals from the proximity switch 58 are arranged to coincide with the signals appearing at the tuned circuit receiver 202. The coincidence gate 60 is employed and is arranged to operate exactly as described above with reference to FIG. 8, so that the loom remains in motion so long as the receiver 202 picks up a signal each time a signal appears at the proximity switch 58, but stops the loom, if, when a signal arrives from the switch 58, no signal is picked up by the receiver 202.

A further system is illustrated in FIGS. 9 and 10, in which there is shown a single shuttle **10*a* and part of the reed retaining ring 300** of the loom. It will be understood that as in the previous examples, the loom may have a plurality of identical shuttles, but for present purposes it is only necessary to describe one shuttle.

Within the shuttle, there is an indicator section 400 (see FIG. 10) on which there are mounted a permanent magnet 402 arranged with its north pole uppermost, and a coil 404 having a vertical axis, the coil being connected to the generator 90, so that when it is energised by the generator, it produces a magnetic flux with a south pole at its upper end. It will be observed that the permanent magnet 402 is arranged a few millimeters in advance of the coil 404 having regard to the direction of travel of the shuttle.

A Hall effect sensor 406 is mounted on the loom above the path of the indicator sections 400 of the shuttles (i.e. it is in a similar position to the single receiver shown in FIG. 7). This sensor 406 is adapted to be activated by both the permanent magnet 402 and the coil 406, but whereas the output signal from the Hall effect sensor produced by the north pole of the permanent magnet is a logical (1) then the output produced by the south pole of the coil will be a logical (0).

The output signals from the sensor 406 are applied to a circuit arranged so that it maintains a steady output state if alternate (1) and (0) are received, and in the steady state it allows the loom drive to continue. However, if two light signals (e.g. two logical "Ones" or two logical "Noughts") are received in succession, then the circuit will switch and disconnect the driving mechanism of the shuttles.

Assuming that there is a proper weft supply from each of the four shuttles in the loom, then as each shuttle passes under the Hall effect sensor, its permanent magnet will produce a logical (1) signal, and its coil will produce a logical (0) signal. Hence, there is a constant alternation between the two possible logical signals, and the loom is kept in motion. Assuming however, that there is a weft failure in one of the shuttles, then as soon as the generator has ceased to produce sufficient current to activate the coil on that shuttle, when that shuttle next passes under the Hall effect sensor, its permanent magnet will produce the logical (1) signal, but no signal will be produced by the coil. When the next succeeding shuttle arrives under the Hall effect signal, its permanent magnet will produce a logical (1) signal and hence the logic circuit will receive two successive logical (1) signals, and this will cause the circuit to switch and bring the loom to rest.

It will be appreciated that there is inevitably an additional time delay when this method is used, because even after the signal has ceased to appear at the coil of a particular shuttle, the control circuit will not detect the weft failure, until 90° later in the loom cycle, when the next shuttle arrives. In many instances however, such a delay is acceptable.

The system described with reference to FIGS. 9 and 10 produces what might be described as logical gating of the detected loom signals. It will be appreciated, that this method of gating could also be used with a radio frequency transmitter arranged as shown in FIG. 7, in place of the coil shown in FIGS. 9 and 10.

Further, it will be appreciated that any of the systems described above, could be modified to operate with a straight shuttle, for operation in a flat loom, so long as the weft package in the shuttle is arranged to rotate in order to drive the generator. Alternatively, in a shuttle in which the weft package does not rotate, it is possible to provide a rotor in the path of the weft leaving the shuttle, so that the rotor is rotated by frictional engagement with the weft, the rotor forming part of the generator.

I claim:

1. A traveling yarn dispenser for use in a textile machine comprising a body, means for mounting a yarn carrier within said body for rotation about the longitudinal axis of the yarn carrier, and an electric generator having a rotor, said rotor being driven from rotation of the yarn carrier.

2. A traveling yarn dispenser for use in a textile machine according to claim 1, wherein said means for mounting a yarn carrier comprises first and second axially aligned rotary mountings each adapted to frictionally engage with a respective end of the yarn carrier, and wherein one of said first and second rotary mountings forms a driving member for said rotor of said generator whereby rotation of the yarn carrier produces rotation of said rotor.

3. A traveling yarn dispenser according to claim 2, including a radio-frequency transmitter adapted to be activated by electrical current produced by said generator.

4. A travelling yarn dispenser according to claim 1, wherein there is a radio frequency transmitter adapted to be activated by electrical current produced by said generator.

5. A textile machine having a traveling yarn dispenser according to claim 4, including a radio-frequency transmitter adapted to be activated by electrical current produced by said generator and a radio-frequency receiver adapted to pick up a signal from said transmitter on said yarn dispenser and to produce a change in a logic output signal in response to excitation by the transmitted signal.

6. A textile machine according to claim 5, wherein there is a plurality of yarn dispensers following the same cyclic path in the machine and at least one aerial providing an aerial system extending around substantially the whole of said cyclic path.

* * * * *